US005715723A

United States Patent [19]

Owens

[11] Patent Number: 5,715,723

[45] Date of Patent: Feb. 10, 1998

[54] HOSE CRIMPING APPARATUS

[76] Inventor: Carl H. Owens, 5105-0302 Phillips Hwy., Jacksonville, Fla. 32207

[21] Appl. No.: 689,842

[22] Filed: Aug. 14, 1996

[51] Int. Cl.[6] ..... B21D 39/04

[52] U.S. Cl. ..... 72/402; 29/237

[58] Field of Search ..... 72/402, 452.3; 29/237

[56] References Cited

U.S. PATENT DOCUMENTS

| | | | |
|---|---|---|---|
| 523,288 | 7/1894 | Little | 72/402 |
| 772,403 | 10/1904 | Cederstrom | 72/402 |
| 936,435 | 10/1909 | Evans | 72/402 |
| 1,457,579 | 6/1923 | Kranz | 72/402 |
| 1,493,515 | 5/1924 | Berthold | 72/402 |
| 1,496,583 | 6/1924 | Lukes | 72/402 |
| 1,761,521 | 6/1930 | Eastman | 72/402 |
| 4,245,453 | 1/1981 | Lillbacka | 72/402 |

FOREIGN PATENT DOCUMENTS

| | | | |
|---|---|---|---|
| 136525 | 10/1980 | Japan | 72/402 |

*Primary Examiner*—Daniel C. Crane
*Attorney, Agent, or Firm*—Thomas C. Saitta

[57] ABSTRACT

A hose crimping apparatus for permanently attaching sleeve fittings onto a hose, the apparatus having a rotating annular cam ring mounted about an opening in a base member with a number of arcuate cam surfaces on its inner surface, the cam surfaces forcing crimping dies radially inward along linear die pathways formed by wedge-shaped die guide members mounted on the base member when the cam ring is rotated.

9 Claims, 4 Drawing Sheets

HOSE CRIMPING APPARATUS

BACKGROUND OF THE INVENTION

This invention relates generally to the field which contains a crimping apparatus for circumferentially attaching a sleeved fitting onto a hydraulic hose or the like. More particularly, the invention relates to a crimping apparatus utilizing a rotating, annular cam ring to force a number of radially disposed crimping dies toward a central axis to compress a fitting onto a hose.

There is currently no available crimping apparatus of simple construction capable of permanently attaching sleeved fittings onto a hose, especially fittings for high pressure hydraulic hoses or the like, which can accommodate hoses and fittings of different size, style and material. Standard fittings have a relatively thick inner metal sleeve and a deformable outer metal sleeve, the end of the resilient, compressible hose being disposed between the two sleeves. The fitting is permanently mounted onto the hose by deforming the outer sleeve by creating a number of inward depressions or crimps circumferentially about the central axis, which forcibly compresses the hose between the two sleeves and prevents removal or disconnection of the fitting from the hose. The known devices for accomplishing this task are relatively complicated in construction and design, have a number of component parts and usually require a powerful press to insure that the connection between fitting and hose is permanent. Most are not readily adaptable for use with multiple size hoses or different fitting configurations.

It is an object of this invention to provide a crimping apparatus which is simple in construction yet powerful enough to be capable of permanently crimping sleeved fittings onto high pressure hoses.

It is a further object to provide such an apparatus which can be operated by a simple hydraulic piston or the like.

It is a further object to provide such an apparatus which utilizes a rotating annular cam ring to impart linear motion to a number of crimping dies mounted radially about an opening for receiving the hose and fitting.

It is a further object to provide such an apparatus which utilizes interchangeable crimping dies for use with hoses and fittings of different size and configuration.

It is a further object to provide such an apparatus which utilizes crimping dies having interchangeable teeth inserts for use with different size or type hoses and fittings.

SUMMARY OF THE INVENTION

The invention is a crimping apparatus for permanently attaching a fitting onto a hose, the apparatus comprising in general a base member having an opening into which may be disposed a hose end and sleeved fitting for crimping, a rotatable annular cam ring mounted onto the base member about the opening, the cam ring having a plural number of arcuate cam surfaces positioned around its inner surface, a torque arm having a fixed end attached to the outer surface of the cam ring and a free or traveling end, actuating or drive means to move the free end of the torque arm to rotate the cam ring relative to the base member, wedge shaped die guide members radially disposed about the opening and fixedly attached to the base member, the die guide members defining linear pathways radially extending from the central axis of the annular cam ring, and a number of linearly movable crimping dies radially disposed in the pathways between the die guide members and inside the annular cam ring. Each crimping die is relatively rectangular in configuration and comprises a main body portion, die rollers mounted onto one end of the main body and a tooth end. The die rollers are adapted to abut the arcuate cam surfaces of the cam ring and the tooth end of the crimping dies are disposed toward the central axis and are adapted to compress the fitting sleeve onto the hose. The tooth end of each crimping die may comprise an interchangeable tooth insert which is abutted against the main body of the crimping die, or which may be held in place magnetically or by interlocking means. The actuating or drive means to move the torque arm is preferably a reciprocating hydraulic piston, but may be a hand operated screw, a powered screw or any other means for producing linear movement to rotate the cam ring. As the cam ring rotates, each crimping die is forced in the inward direction by the arcuate cam surfaces on the inside of the cam ring, linearly forcing the tooth end of each crimping die toward the central axis to forcibly crimp the fitting onto the hose end disposed along the central axis. Hoses and fittings of different sizes, types or configurations are accommodated by varying the length and/or configuration of the crimping dies.

DETAILED DESCRIPTION OF THE INVENTION

With reference to the drawings, the invention will now be described in detail with regard to the best mode and preferred embodiment. The invention relates in general to a crimping apparatus for permanently attaching a separate sleeve-type fitting onto the end of a hose made of resilient, compressible material. The sleeve fitting comprises a relatively strong and non-deformable inner tubular sleeve, which may be the free end of a particularly configured tube, which is disposed within the internal bore of the hose, and a deformable outer tubular sleeve which is disposed about the external end of the hose, where the hose is of the type used for delivering gas or liquid under pressure, such as a hydraulic hose used on vehicles or machinery. By forcibly deforming or crimping the outer sleeve against the inner sleeve, with the compressible hose positioned therebetween, a relatively permanent attachment is attained and the fitting can now be used to connect the hose to a corresponding coupling device as desired.

Figure 1:
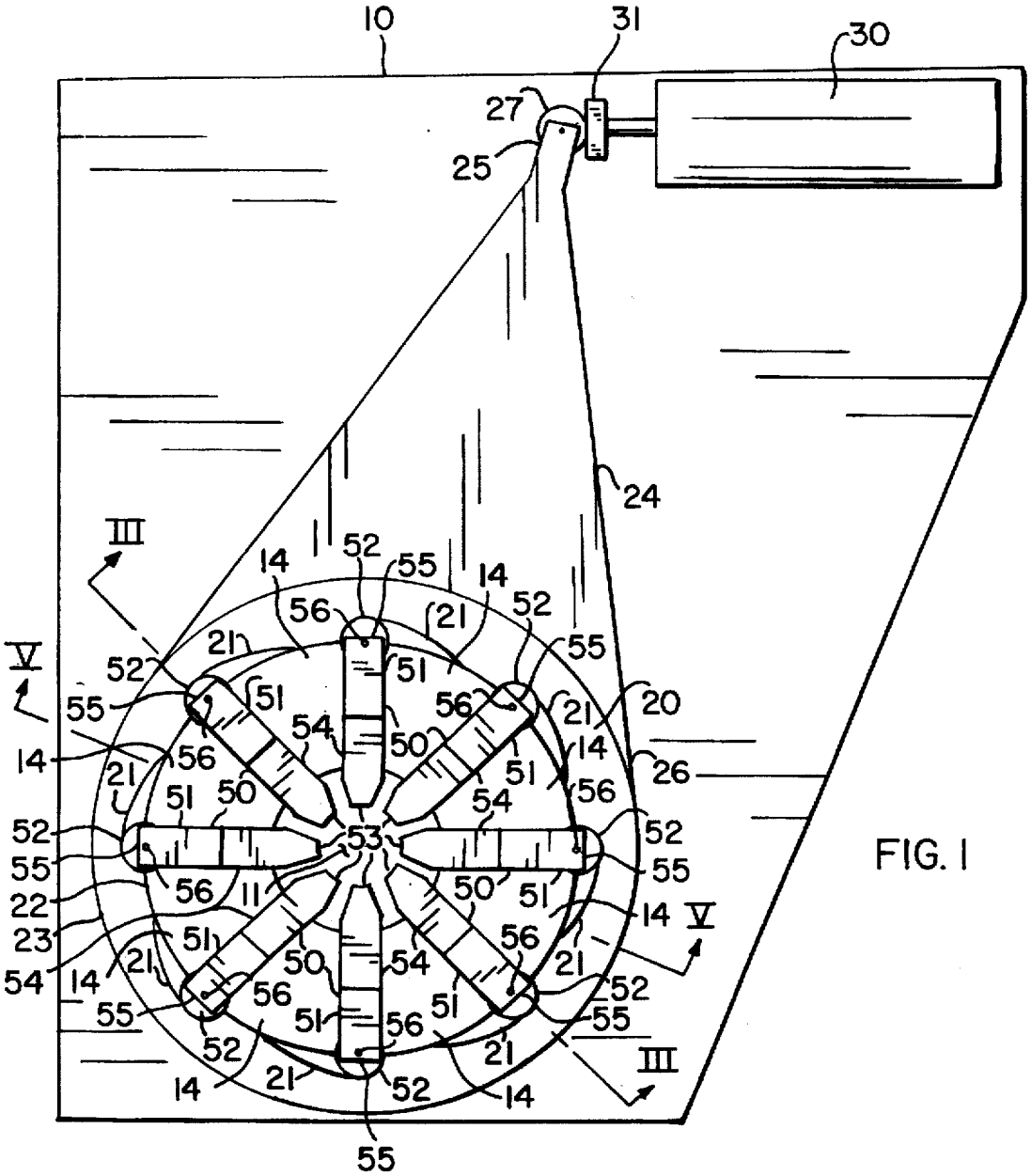
FIG. 1 is a top view of the invention with the crimping dies shown in the retracted or fully open position.
Figure 2:
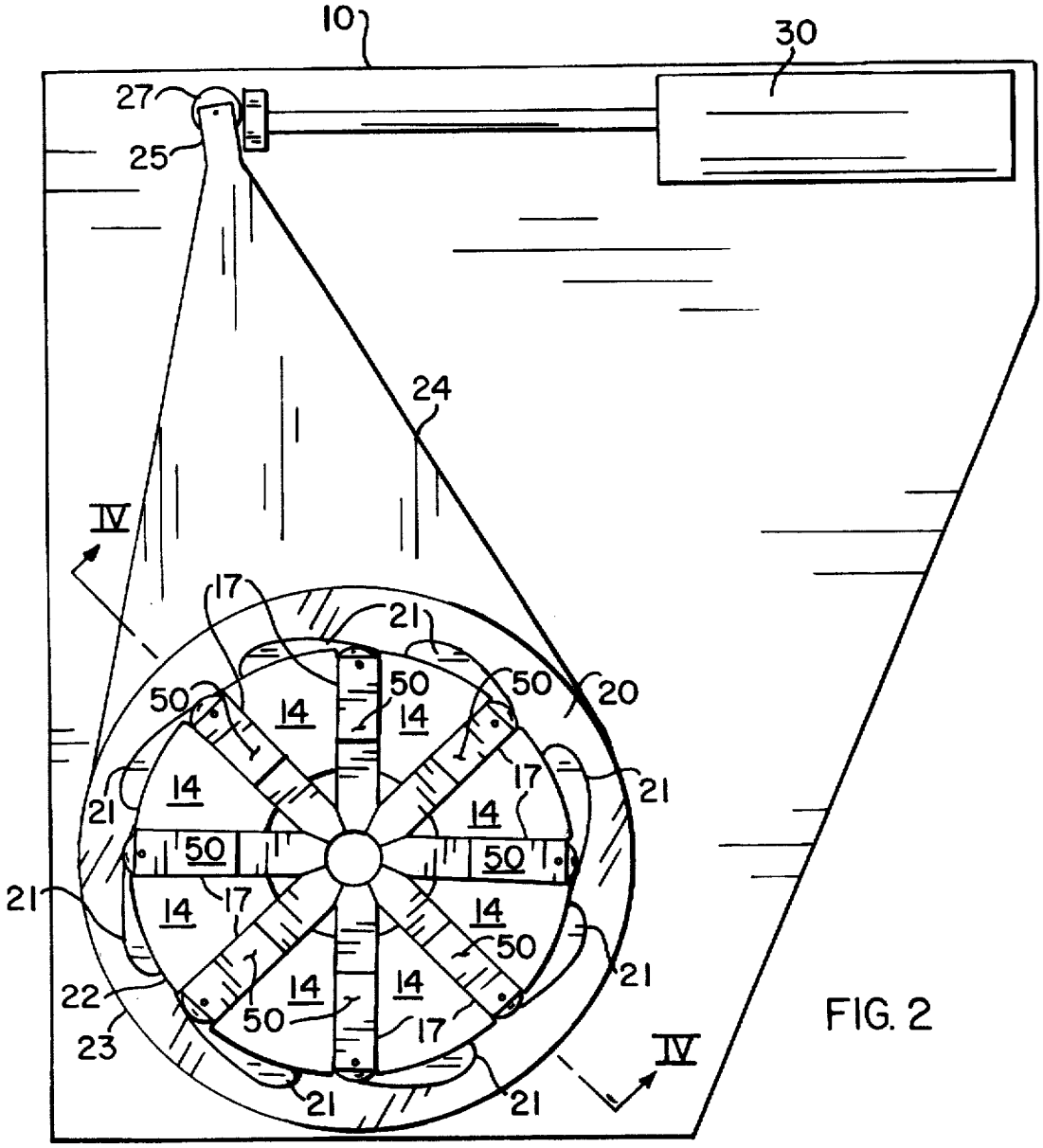
FIG. 2 is a top view showing the crimping dies in the closed or crimping position.
Figure 3:
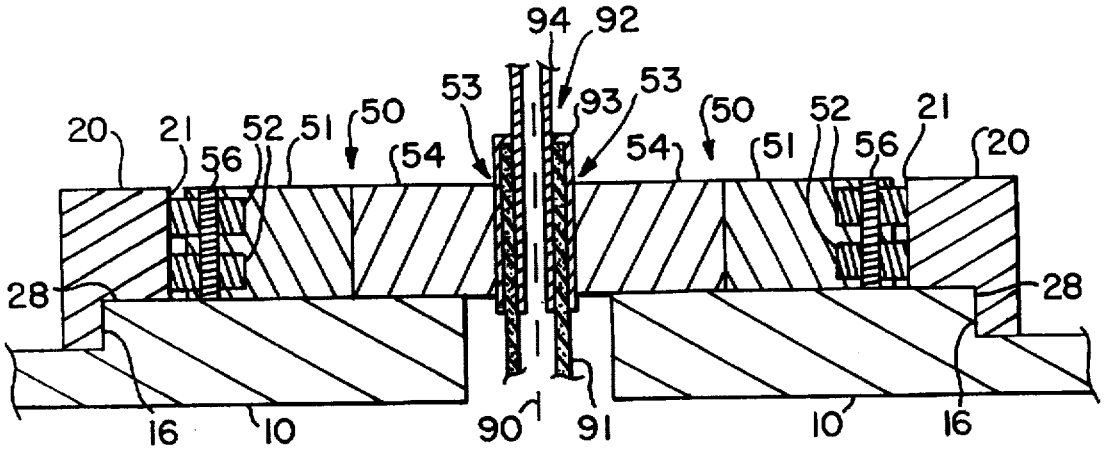
FIG. 3 is a cross-sectional view taken along line III—III of FIG. 1.
Figure 5:
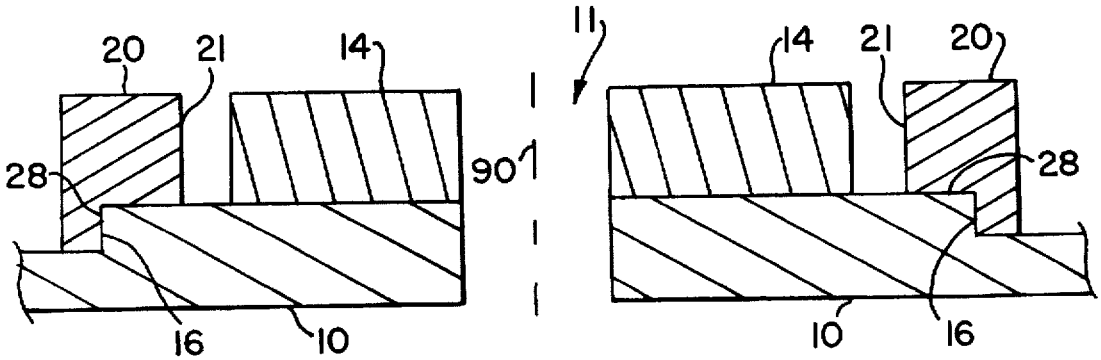
FIG. 5 is a cross-sectional view taken along line V—V of FIG. 1.
Figure 4:
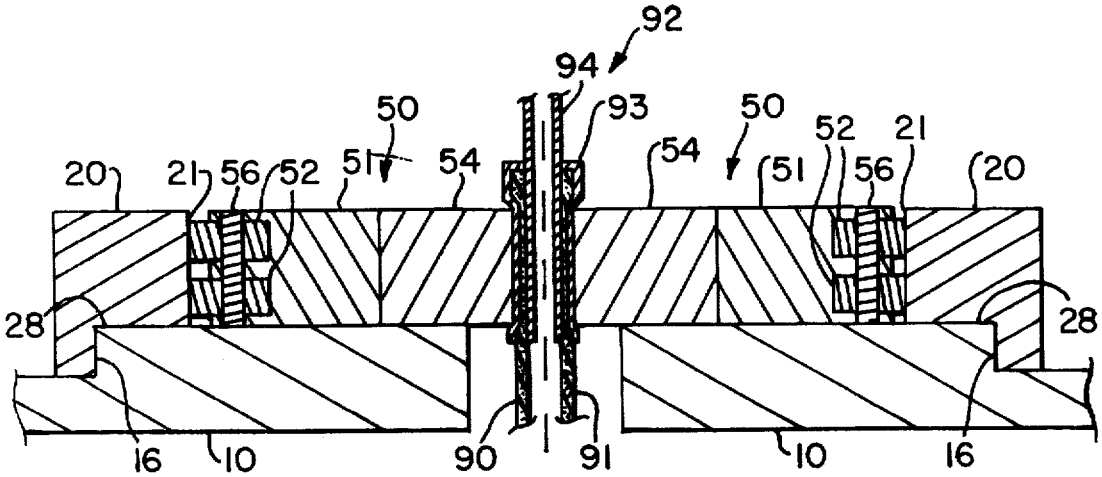
FIG. 4 is a cross-sectional view taken along line IV—IV of FIG. 2.

Referring now to FIG. 1, the apparatus is shown to comprise in general a base member 10, an annular cam ring 20, actuating or drive means 30, and crimping dies 50. The base member 10 is preferably a generally planar piece for mounting the various components of the apparatus, preferably composed of a steel plate or the like, and may be adapted for suitable mounting on support members or legs to provide a stationary working environment. The base member 10 contains an opening 11, preferably circular, through which the end of a hose and an attachable fitting may be disposed for crimping by the apparatus. Preferably connected directly to the base member 10 is actuating or drive means 30 for rotating the cam ring 20. Actuating means 20 may comprise any suitable means for rotating the cam ring 20, but preferably comprises a reciprocating hydraulic piston. Alternatively, the actuating means 20 may be for example a hand operated screw-drive device, an electrically operated screw-drive device, a lever mechanism, or any other similar type drive mechanism for providing sufficient power to rotate the cam ring 20. Cam ring guide means 12 is disposed about the opening 11 in base member 10 to retain cam ring 20 and control its rotation about the central axis 90, such that annular cam ring 20 is mounted onto base member 10 around the opening 11 in a manner which allows rotation of cam ring 20 relative to base member 10 and about its central axis 90. Preferably, cam ring guide means 12 comprises a raised annular shoulder or rim 16 adapted to abut a corresponding annular recess 28 on the bottom of the cam ring 20, as seen in FIGS. 3, 4 and 5. Alternatively, the cam ring guide means 12 could be a groove or recess located in base member 10 which would receive an annular lip on the bottom of cam ring 20. In still another alternative embodiment, the cam ring guide means 12 could comprise a number of roller members affixed to the based member 10 about the annular outer surface 23 of the cam ring 20. In the preferred embodiment, a torque arm 24 is connected to the outer surface 23 of cam ring 20, the torque arm 24 having a free end 25 and fixed end 26 preferably connected at opposing points on the outer surface 23 of cam ring 20. Movement of the free end 25 of torque arm 24 by actuating means 30 rotates annular cam ring 20 relative to the base member 10 and opening 11. Preferably, either the free end 25 of torque arm 24 or the ram end 31 of actuating means 30 comprises one or more torque rollers 27 to reduce friction during extension or retraction of the ram end 31.

Radially disposed about the opening 11 of base member 10 are a number of upwardly extending die guide members 14, preferably relatively wedge shaped. Die guide members 14 may be formed as an integral part of base member 10 or may be formed separately and suitably attached in secure manner to base member 10 by mechanical fasteners or the like. The die guide members 14 are positioned internally within annular cam ring 20 and are constructed to form a radially extending die pathway 17 between each adjacent die guide member 14, the die pathway 17 being formed to receive a crimping die 50, the combination of adjacent die guide members 14 allowing only linear radial movement of the die crimpers 50 toward and away from the central axis 90 within die pathways 17.

Figure 7:
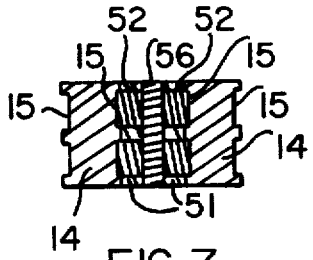
FIG. 7 is a partial cross-sectional view taken along line VI—VI of FIG. 1 showing a crimping die between adjacent die guide members.
Figure 6:
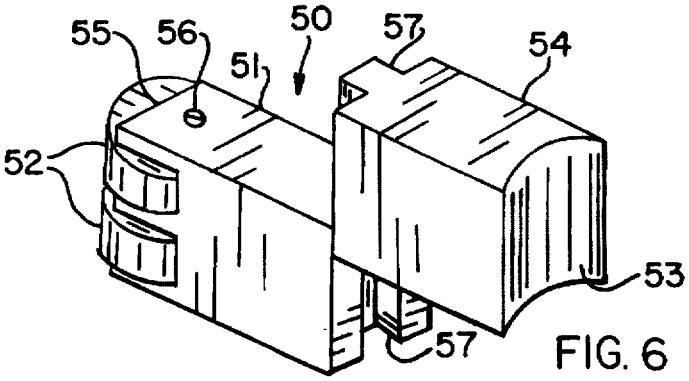
FIG. 6 is a perspective view of an alternative version of the crimping die showing a tooth insert with interlocking means partially removed from the main body.

The annular cam ring 20 has an outer surface 23 to which is attached the torque arm 24, with torque arm 24 being preferably a generally triangular member attached to the outer surface 23 of cam ring 20 at opposing points 180 degrees apart. The inner surface 22 of cam ring 20 contains a number of matching arcuate cam surfaces 21, each cam surface 21 varying in depth in the same direction and to the same degree. The cam surfaces 21 are located to correspond to the die pathways 17 in a one-to-one relationship. Crimping dies 50 are positioned within the die pathways 17 between the die guide members 14. Each crimping die comprises a main body 51, die rollers 52 and a tooth end 53. The main body is preferably generally rectangular, and the die rollers 52 are mounted onto the main body 51 by a pin 56 on the outer end 55 of the main body such that the die rollers 52 extend beyond the outer end 55 and contact the arcuate cam surfaces 21 of cam ring 20 in order to reduce friction between the crimping dies 50 and the cam ring 20. Preferably, the die rollers 52 are sized relatively large and may extend beyond the sides of main body 51, in which case die roller recesses 15 are cut into the sides of die guide members 14, as shown in FIG. 7. Each tooth end 53 of each crimping die 50 is configured to provide a compression surface to properly deform the outer sleeve 93 of a sleeve fitting 92 against the inner sleeve 94 of the fitting 92, thereby entrapping the compressible hose 91 between the two. Preferably, the tooth end 53 is configured with a curved surface. The tooth end 53 may be formed with as an integral part of the main body 51 of crimping die 50, but preferably the crimping die 50 is provided with a removable, interchangeable tooth insert 54. In order to crimp fittings 92 onto hoses 91 of different diameters, it is necessary to adjust the length of the crimping dies 50, since the linear movement of the crimping dies 50 toward the central axis 90 is limited to the change in depth of the arcuate cam surfaces 21 of cam ring 20. For small diameter hoses 91 the tooth ends 53 of the crimping dies 50 must be driven more closely to the central axis 90 than for large diameter hoses 91. By providing interchangeable tooth inserts 54, the length of the crimping dies 50 or the configuration of the tooth ends 53 themselves may be changed as required. The tooth insert 54 may be independent of the main body 51, but preferably is connected either magnetically or by mechanical interlocking means 57, as shown in FIG. 6.

In order to attach a sleeve fitting 92 onto a hose 91, the actuating means 30 is fully retracted to rotate the cam ring 20 such that the deep portion of each arcuate cam surface 21 is aligned with each die pathway 17, as shown in FIG. 1. This allows the crimping dies 50 to be disposed outwardly to provide an unobstructed open area around central axis 90. The sleeve fitting 92 is placed onto the hose 91 with the inner sleeve 94 positioned in the bore of the hose 91 and the outer sleeve 93 positioned external to the hose 91. The hose 91 and fitting 92 is aligned on the central axis 90 in opening 11 of base member 10, as shown in FIG. 3. The actuating means 30 is then activated to move torque arm 24 to rotate cam ring 20. The rotation of cam ring 20 moves the arcuate cam surfaces 21, thus driving the crimping dies 50 inward along die pathways 17 toward the central axis 90. The tooth ends 53 of the crimping dies contact and deform the outer sleeve 93 of fitting 92 against the hose 91 and the inner sleeve 94, thereby securely attaching the fitting 92 to the hose 91, as shown in FIG. 4. Because of the simple design and large opening 11 in base member 10, hoses or fittings of odd and complicated configurations can be accommodated by the apparatus.

It is contemplated that equivalents and substitutions for elements described above may be known to those skilled in the art. The true scope and definition of the invention therefore is to be as set forth in the following claims.

I claim:

1. A hose crimping apparatus for permanently attaching sleeve fittings onto a hose, the apparatus comprising:

a base member having an opening;

a rotating annular cam ring seated onto said base member about said opening, said cam ring having a central axis, an inner surface and a plural number of arcuate cam surfaces positioned on said inner surface;

cam ring guide means attached to said base member;

actuating means to rotate said cam ring;

die guide members attached to said base member, said die guide members disposed radially about said opening to form radially extending die pathways and having die roller recesses to receive die rollers;

crimping dies disposed within said die pathways, each of said crimping dies having a main body with an outer end having die rollers mounted thereon, said die rollers contacting said arcuate cam surfaces of said cam ring and each of said crimping dies having a tooth end for crimping a sleeve fitting onto a hose positioned on said central axis within said opening of said base member, whereby rotation of said cam ring by said actuating means forces said crimping dies radially inward toward said central axis, said die rollers extending beyond said outer end and extending beyond said main body into said die roller recesses in said die guide members.

2. The apparatus of claim 1, where said cam ring further comprises a torque arm attached to said cam ring, where said actuating means moves said torque arm to rotate said cam ring.

3. The apparatus of claim 1, where said cam ring guide means comprises a raised annular shoulder on said base member, and said cam ring further comprises an annular recess corresponding to said raised annular shoulder, where said cam ring is seated onto said base member without further attachment means and can be removed from said base member by raising said cam ring in the direction of the central axis to expose said main bodies of said crimper dies for removal in the radial direction.

4. The apparatus of claim 1, where said die guide members are generally wedge-shaped.

5. The apparatus of claim 1, where each said crimping die comprises a main body and each said tooth end of each said crimping die comprises a tooth insert removable from said main body.

6. The apparatus of claim 5, where each said tooth insert is mechanically joined to each said main body.

7. The apparatus of claim 5, where each said tooth insert is magnetically joined to each said main body.

8. The apparatus of claim 1, where said actuating means is a hydraulic piston.

9. The apparatus of claim 1, where said actuating means is a screw-drive mechanism.

* * * * *